United States Patent [19]

Latussek

[11] Patent Number: 4,601,937

[45] Date of Patent: Jul. 22, 1986

[54] TEMPORARY COMPACTION OF FIBER NON-WOVENS

[75] Inventor: Eberhard Latussek, Wesel, Fed. Rep. of Germany

[73] Assignee: Akzona Incorporated, Asheville, N.C.

[21] Appl. No.: 542,832

[22] Filed: Oct. 17, 1983

[30] Foreign Application Priority Data

Dec. 31, 1983 [DE] Fed. Rep. of Germany ..... 3248753

[51] Int. Cl.[4] ..... B65B 63/04; D04H 1/44

[52] U.S. Cl. ..... 428/132; 2/69.5; 2/97; 2/102; 2/272; 38/144; 52/743; 53/430; 242/55.1; 428/136; 428/137; 428/167; 428/171; 428/172; 428/195; 428/207; 428/224; 428/284; 428/286; 428/287; 428/288; 428/290; 428/298; 428/302; 428/913

[58] Field of Search ..... 38/144; 53/430; 242/55.1; 428/132, 136, 137, 167, 171, 172, 175, 207, 224, 284, 286, 287, 288, 290, 298, 302, 913

[56] References Cited

U.S. PATENT DOCUMENTS

| | | | |
|---|---|---|---|
| 546,009 | 9/1895 | Graves | 53/430 |
| 3,458,966 | 8/1969 | Dunbar et al. | 53/430 |
| 3,537,226 | 11/1970 | Le Van et al. | 53/430 |
| 3,813,843 | 6/1974 | Wooldridge et al. | 242/55.1 |
| 3,911,641 | 10/1975 | Miller et al. | 53/430 |
| 3,927,504 | 12/1975 | Forrister | 53/430 |
| 3,964,232 | 6/1976 | Bender et al. | 53/430 |
| 3,991,538 | 11/1976 | Finn et al. | 242/55.1 |
| 4,163,353 | 8/1979 | Finn et al. | 53/430 |

*Primary Examiner*—James C. Cannon

*Attorney, Agent, or Firm*—Francis W. Young; Tom R. Vestal

[57] ABSTRACT

A method of temporarily densifying a bulky non-woven matting or fabric for handling and storage is disclosed, wherein the non-woven is heated, preferably to a temperature above 100° C. but below the softening temperature while in a compacted state, then immediately cooled in the compacted state. Means for reducing stiffness of the compacted matting are also disclosed.

6 Claims, 6 Drawing Figures

TEMPORARY COMPACTION OF FIBER NON-WOVENS

DESCRIPTION OF THE PRIOR ART

The invention refers to a process for the compacting of fiber non-wovens by means of heat and pressure.

Processes for the permanent, i.e., irreversible strengthening of fiber non-wovens by means of heat and/or pressure, using binding agents, e.g., binder fibers, are known. In these processes, the binding agent present on the non-woven surface and/or within the non-woven is transformed to a liquid, plastic, or pasty state by means of dry or moist heat, thus bringing about local adhesion of the fibers making up the non-woven, in particular at their points of intersection, thus resulting in an increase in the strength of the non-woven.

Processes are also known in which the binding agent is dissolved in or mixed with a liquid and sprayed on the non-woven. A strengthening of the non-woven is accomplished by subsequent evaporation of the liquid.

Compaction also accomplished by such processes is irreversible. In addition, utilization of such binding agents, no matter of what kind, requires additional technical and financial expenditures.

Finally, processes are also known in which the properties of the fibers forming the non-woven make it possible to accomplish a strengthening of the non-wovens without binding agents, i.e., by making the fibers fuse or adhere to one another at their points of intersection. Here, too, any compacting that has occurred is irreversible.

High bulk of the non-woven material is an essential prerequisite for certain end use application. Shipment of such a product, however, results in a high transport cost per unit weight, since the density factor of the non-woven is inversely proportional to the "height" or bulk of the material per given weight. High bulk materials are also more difficult to cut, sew, stitch, etc.

BRIEF DESCRIPTION OF THE INVENTION

The present invention based on the problem of providing a substantial improvement and simplification for transporting and processing of strips of non-wovens which, because of their high volume (bulkiness) or their great thickness, are preferred for certain purposes, e.g., as filling material or insulated clothing. The improvement comprises compressing these strips of non-woven materials for transportation and/or processing to a lesser volume, i.e., a greaer density, in particular to a lesser thickness, than would correspond to the density during the intended use of the strip of non-woven, or of the products made therefrom, whereby this compacted state can be maintained for as long as desired without any targeted action, but if this should be desired, can at any time, at least for the most part, be revoked again, so that it is reversible. Another problem solved by the invention lies in the fact that in those cases where a compacted fiber non-woven is desired in the end product, compacting of the non-woven can be accomplished wherever possible without binding agent and at lower temperatures than heretofore customary, i.e., with a savings of energy.

This problem is solved by a process for the compacting of fiber non-wovens by means of heat and without the use of binding agents, in which, pursuant to the invention, the heat treatment of the non-woven, which is carried out under pressure (warm pressing) is immediately followed by cooling under the influence of substantially unchanged pressure.

The process pursuant to the invention makes it possible to reverse the compacting of the fiber non-woven in many cases completely, in most cases for the greatest part, but in all cases at least in part.

Those non-wovens are especially suitable for the execution of the process pursuant to the invention, which consists wholly or largely, but at least in part, of natural or synthetic fibers with resilient characteristics. In general, such non-wovens themselves also exhibit resiliency, i.e., they are pressure-elastic and, after a brief cold deformation, will either immediately, but at least after a short time, resume their original bulk. Thereby, the resiliency of the fibers or non-wovens may be the result of natural elastic characteristics of the fibers under a bending stress, or of appropriate treatment, e.g., texturing of the fibers, or of appropriate structuring of the non-wovens themselves.

By fiber non-woven within the meaning of the present invention is understood a flat, shaped article which may consist of spun fibers (staple fibers) or continuous filaments, or of a mixture of both. It therefore also covers, e.g., cotton batting.

It has also been found that, frequently, the compacting of fiber non-wovens accomplished by the process pursuant to the invention will also meet other requirements than those mentioned above, so that in those cases it is possible to do without the heretofore customary expensive processes for compacting of fiber non-wovens as explained above.

On the other hand, the possibility to make the compacting obtained by means of the process pursuant to the invention reversible under the mentioned conditions offers considerable advantages for transportation and further processing in particular of those fiber non-wovens which, in the uncompacted state, have a high volume (in particular a high thickness) and where especially this characteristic constitutes the criterium decisive for their use. The complete, or partial reversing of the previously accomplished reversible compacting of the fiber non-woven is therefore an essential development of the process pursuant to the invention.

Whether and to what extent the process pursuant to the invention will be effective in the case of a non-woven not yet investigated in this respect can be determined by means of simple experiments with samples of the non-woven in question. For this purpose, appropriate sections of the non-woven are subjected to different processing conditions, which are at first within the ranges recognized to be advantageous, whereupon the effect of these conditions is determined by means of comparison measurements, e.g., of the thickness of the non-wovens subjected to different treatments, and of the untreated non-woven. When a compacting of the non-woven has been accomplished, it can subsequently be determined in an equally simple manner whether and to what extent this compacting is reversible. For this purpose, it is generally sufficient to subject the compacted non-woven specimen without any application of surface or other pressure to essentially the same conditions under which compacting had first been accomplished. Thereby, a more rapid, or more intensive effect is generally obtained when water vapor is applied to the non-woven.

The fact that under the mentioned conditions, fiber non-wovens can also be compacted (compressed) without binding agent with the process pursuant to the invention does not mean, however, that a non-woven which has first been reinforced with a binding agent, or by some other means, could not, or should not also be successfully subjected to the process pursuant to the invention. Such binding agents are merely not necessary to compact a fiber non-woven with the process pursuant to the invention and, if compacting of the fiber non-woven is to be reversible, a binding agent that might be present must not undergo a change in its state of aggregation during warm pressing pursuant to the invention. For example, a non-woven of crimped polyester fibers, both surfaces of which have been reinforced with an acrylic resin binder, can successfully be first compacted and subsequently, by treating it with water vapor, be returned to its original, uncompacted state without inflicting any damage to the surface reinforcement.

The extent of compaction of the fiber non-woven can be influenced by a change in the pressure used (pressure per unit of area) and in the temperature used, whereby the use of moist heat, e.g., during warm pressing in a steam atmosphere, will in general result in a higher compacting of the non-woven than with dry heat.

Especially good results are obtained when the process pursuant to the invention is carried out at temperatures above 100° C., in particular above 110° C., but below a perhaps existing softening temperature, or other temperature responsible for a change in the state of aggregation of the fibers used in the non-woven.

The process pursuant to the invention is suitable for fiber non-wovens of natural fibers, such as wool or cotton, as well as for those made of artificial and synthetic fibers, e.g., of regenerated cellulose, polyamide, polyacrylonitrile, polypropylene, and the like, as well as mixtures of such fibers, whereby especially good results are obtained with fiber non-wovens consisting wholly or in part of polyester fibers. Beyond that, non-wovens suitable for the process pursuant to the invention may consist entirely or partly of hollow fibers.

The non-wovens suitable for the process pursuant to the invention may have been prepared by means of a wet or a dry process, e.g., as spun non-wovens, carding or slubbing non-wovens, aerodynamically formed non-wovens, etc., and several layers may have been placed on one another.

Furthermore, so-called oriented non-wovens, in which the fibers are preferably lying in one direction, or intersecting non-wovens, in which the fibers are preferably oriented in two directions by an intersecting of the nap, as well as tangled fiber non-wovens, in which the fibers do not exhibit any preferred orientation, may be subjected to the process pursuant to the invention.

For non-wovens which, for whatever reason, e.g., because of the way in which they were manufactured, already have a low thickness (height), the process pursuant to the invention is of less significance than for those non-wovens which have a height (thickness) within a range from one to several centimeters and can, when subjected to a pressure per unit of area of, e.g., 6 $cN/cm^2$, be compressed to half their thickness (height). Depending upon the type of fibers of which they consist, such non-wovens can, by using higher pressures during warm pressing, without difficulty be compressed to, e.g., $\frac{1}{4}$ to 1/5 of their thickness (height) and less by applying the process pursant to the invention.

Using the process pursuant to the invention, especiallY good results, i.e., a high compacting of the non-woven, were reached when the non-woven consisted entirely or partly of polyester fibers. Such fiber non-wovens, also referred to as filler non-wovens, are, e.g., used extensively for the quilting of clothing, comforters, sleeping bags and the like, whereby the fibers used, or only a part thereof, may be crimped.

If desired, the fiber non-wovens compacted according to the process pursuant to the invention may also be used without a shell, or covering, in which case they may advantageously be also made available in a colored or patterned make-up. This can be accomplished by subjecting the non-woven to be compacted to thermoprinting during warm pressing, if necessary, also before or after that.

In a further development of the process pursuant to the invention, this process can be carried out in such a way for the manufacture of non-wovens with a non-plane, i.e., structured, corrugated, ribbed or shaped surface, that the non-woven is exposed to the influence of heat and/or pressure only in certain places, or ranges, or in sections.

In general, fiber non-wovens to be used as filler non-wovens in clothing or other commodities are covered with a shell on what is later to become the outside, and with a lining on the future inside, which are joined by stitching. This stitching serves to fix the filler non-woven between the two covering fabrics. It is possible to do partly or entirely without this stitching if, in a further development of the invention, a thermoplastic binding agent is applied to the upper and/or lower side of the compacted non-woven. A superficially applied binding agent applied in the above manner may be present in any desired form, and may be applied in any desired manner, making it possible to fasten the shell and/or lining to the filler non-woven in a manner that is generally of adequate strength. This fastening can, e.g., be accomplished by the influence of heat and in an especially advantageous, as well as rapid and simple manner during ironing, or so-called finish steaming of the commodity or item of clothing.

Fiber non-wovens, especially if they are present in the form of long strips, can be compacted continuously, e.g., on calenders. Since the fiber non-wovens, after they have been subjected to warm pressing, must not puff up before and during the cooling which follows, they must, for this purpose, be held in the compressed state by an adequate pressure per unit of area. When calenders or similar, continuously functioning devices are used, it is therefore advisable to provide an upper and lower belt of textile or metallic material between the rollers and the fiber non-woven, by means of which the non-woven is, in a simple manner, held in the compressed state even after the warm pressing zone, i.e., before and during the cooling pressing zone. Smaller pieces of fiber non-wovens can be compacted, e.g., on ironing presses or similar equipment. The same applies analogously to thermoprinting, or to the localized compacting of fiber non-wovens. In the case of continuous processes, a localized compacting of the non-woven can, e.g., be effected by an appropriately shaped transport belt.

The complete or partial restoration of the original bulk of the fiber non-woven, the so-called steaming, or finish steaming, can likewise be performed continuously or discontinuously. After they have been provided with the compacted fiber non-woven pursuant to the invention, finished or semi-finished goods can also be subjected to this possible step of the process pursuant to the invention, either singly or in groups.

The process pursuant to the invention is, however, not only suitable for non-wovens to be used in industries making clothing or textiles for the home, but also for non-wovens to be used in industrial areas, such as, e.g., damping or insulating material.

In these cases as well, the fiber non-wovens intended for these purposes can first be compacted pursuant to the invention in order to lower space requirements during storage and transporting and, as required, be returned to their original state by steaming. Such a procedure would offer itself in those cases in particular where fiber non-wovens intended for insulation have to be placed into narrow gaps. There, expansion steaming would suitably be carried out only after installation.

In the case of clothing, the possibility to compact fiber non-wovens pursuant to the invention in a reversible manner can, e.g., be utilized in such a way that in order to use the item of clothing during the warm season, the non-woven filler or liner is compacted pursuant to the invention, while the original full bulk of the filler is restored by steaming of the garment before the start of the cold season.

Non-wovens compacted (compressed) pursuant to the invention may have a higher degree of stiffness than uncompacted ones, which may occasionally be found to be disadvantageous or annoying. In such cases, the flexibility of the compacted non-wovens may be increased by slitting or cutting their surface, punching of holes, and the like.

An object of the invention is also a fiber non-woven of the above-described kind, which, at temperatures within a range from 100° C. to 110° C. and above, in particular in a water vapor atmosphere, will assume a volume that is at least twice as big, in particular twice as thick, as before this treatment.

BRIEF DESCRIPTION OF THE DRAWINGS

The invention will now be explained in greater detail by referring to the following drawings.

DETAILED DESCRIPTION OF THE DRAWINGS

Figure 1A:
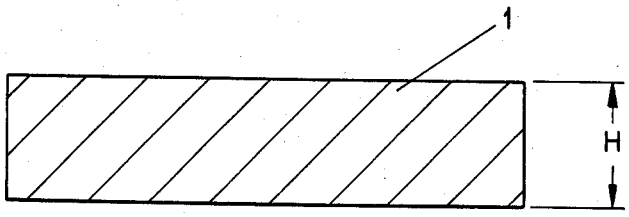
FIG. 1*a* is a cross section of an uncompacted strip of non-woven.
Figure 1B:
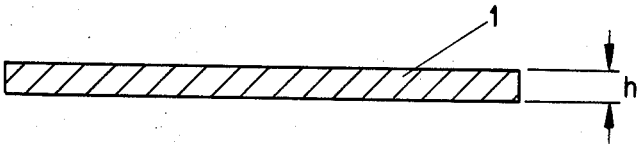
FIG. 1*b* is a cross section of a strip of non-woven compacted pursuant to the invention.

FIG. 1*a* shows a cross section of a fiber non-woven 1 before compacting pursuant to the invention. The initial height (thickness) of the strip of non-woven is H. FIG. 1*b* shows a cross section of the same strip of non-woven 1 after compacting pursuant to the invention. The height (thickness) of this reversibly compressed, if required, strip of non-woven is now h.

Figure 2:
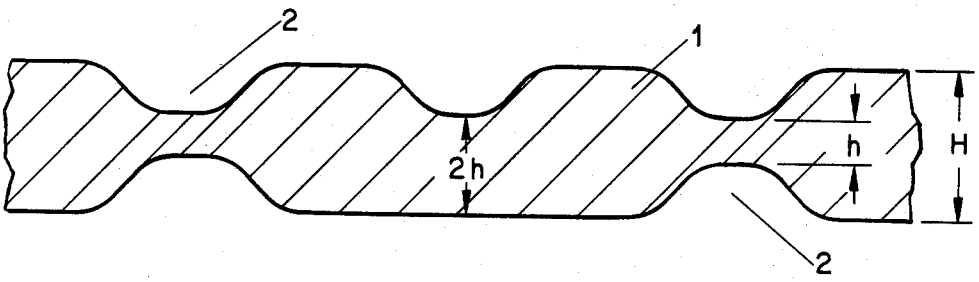
FIG. 2 is a cross section of a strip of non-woven, compacted only in places pursuant to the invention.

FIG. 2 shows a cross section of a strip of non-woven 1, which has only locally been compacted pursuant to the invention and thus exhibits indentations 2 in the compacted regions. Viewed from above, these indentations 2 may be shaped circular, oval, polygonal, etc., or funnel-shaped, hemispherical, like a groove, or in a similar manner, and may run longitudinally, transverse, diagonally, wave-shaped, zigzag, etc., and may also be interrupted in places. The height of the uncompacted area of the strip of non-woven is H. As is in addition shown by FIG. 2, localized compacting of a strip of non-woven 1 can be carried out in such a way that the indentations 2 are formed on only one side, or else on both sides of the strip of non-woven 1, so that the degree of compacting of a strip of non-woven 1 may vary at different locations. Thus, the height (thickness) of the compacted area in the middle of the cross section of the strip of non-woven is twice that of the outside areas, namely 2h.

Figure 3:
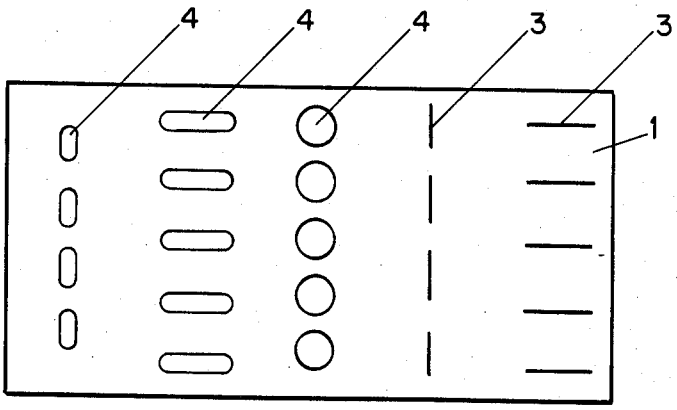
FIG. 3 is a top view of a strip of non-woven compacted pursuant to the invention, with punched out or slitted regions.

FIG. 3 shows in top view a fiber non-woven 1, compacted by means of the process pursuant to the invention, which exhibits areas 4, that have been punched out. Punching out can be performed either before, or else after compacting of the fiber non-woven 1 pursuant to the invention, and provides the compacted fiber non-woven 1 with a better pliability or flexibility. Looking at them from left to right, the punched out areas 4 are, e.g., shown as being vertical, horizontal or circular recesses (holes), or as vertical or horizontal fissures, or cuts 3. They may, however, also be formed and dimensioned in any other way. It is also possible to arrange not only one, but different shapes of these punch holes 4, or cuts 3, in one strip of non-woven. The strip of non-woven compacted pursuant to the invention, which is shown in FIG. 3, exhibits a uniform, but lesser height (thickness) than before compacting.

Figure 4:
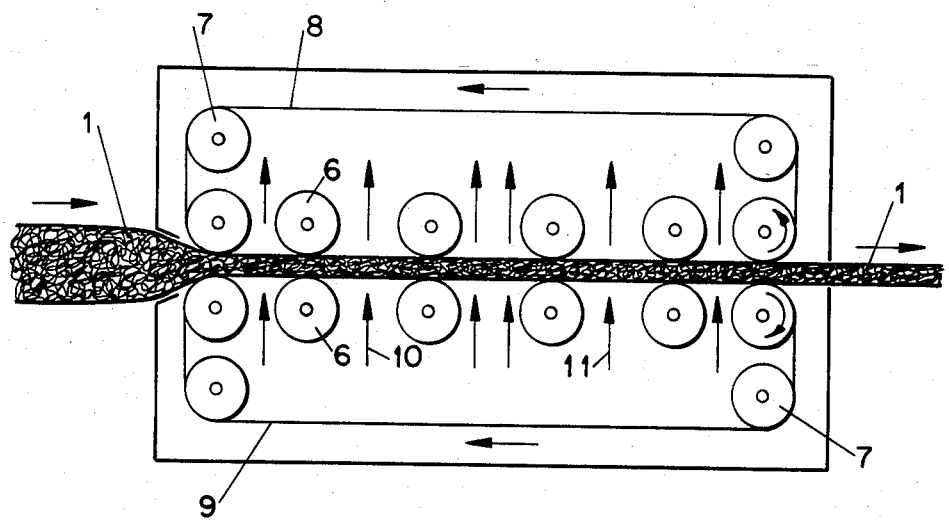
FIG. 4 shows a device in a simplified, schematic manner for the compacting of a strip of non-woven pursuant to the invention.

FIG. 4 shows in a simplified, schematic representation a device with which the compacting pursuant to the invention of strips of fiber non-woven of any desired length can be carried out continuously. The devices has several rolls 6, arranged in pairs, and an upper endless belt 8, as well as a lower endless belt 9, both of which are guided over deflecting rolls 7. The drive, causing the rolls 6 and 7 to revolve and the endless belts 8 and 9 to move, is not shown. The endless belts 8 and 9 transport the strip of non-woven 1 in the direction indicated by arrows. The spacing between the rolls 6 forms a gap between the endless belts 8 and 9, which is sufficient to attain the desired compacting of the strip of non-woven 1. As is also shown by FIG. 4, the strip of non-woven 1, in the uncompacted state, enters from the one side into the gap formed by endless belts 8 and 9 and leaves it again at the other side in a compacted state. This is achieved by subjecting the fiber non-woven 1 to a heat treatment in the state of compression brought about by the said gak, e.g., conducting a warm gas 10, warm air 10, water vapor 10, or a gas, or air and steam mixture 10 through the strip of non-woven 1, whereupon immediately after that, i.e., likewise in the compressed state brought about by the said gap, the strip of non-woven 1 is cooled, e.g., by conducting cold air 11, or a cold gas 11 through the non-woven 1. For this purpose, the endless belts 8 and 9 have to be permeable to gas or vapor. However, the heat treatment and/or cooling of the strip of non-woven 1 can also be accomplished without flowing fluids 10, 11, thus, e.g., by a mere surface contact of the strip of non-woven 1 with heated and/or cooled endless belts 8 and 9.

Figure 5:
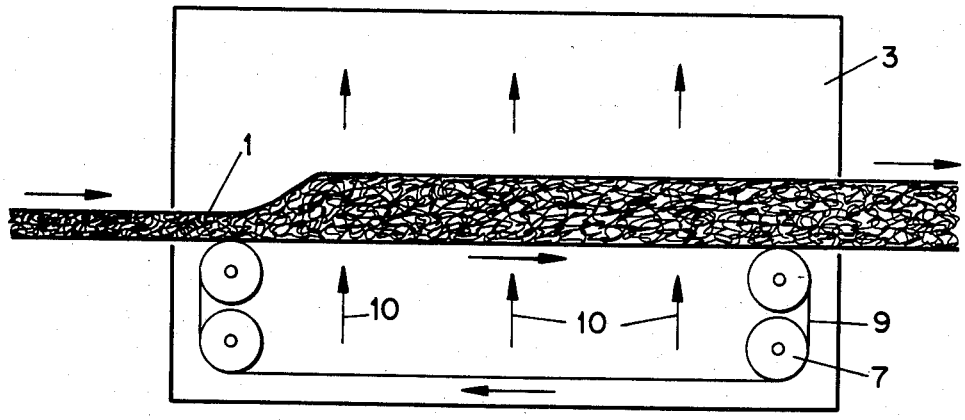
FIG. 5 depicts a restoration as feasible pursuant to the invention, of the reversible compacting pursuant to the invention of a strip of non-woven, in continuous operation, shown in a simplified schematic representation.

FIG. 5 shows a device in a simplified, schematic representation, by means of which a fiber non-woven 1, compacted pursuant to the invention, of any desired length, can be continuously subjected to a heat treatment, by means of which the strip of non-woven can be returned to an uncompressed state, which may correspond completely or in part to the original state. Essentially, this device consists of a chamber 3 supplied with warm air, a warm gas, water vapor, or an air or gas/steam mixture, through which chamber the compacted strip of non-woven 1 is conducted and in which, under the influence of the heat, which may be a moist heat, it can again assume a noticeably greater volume, in particular a greater thickness (height), since this increase in volume does not encounter any resistance.

In the devices shown in FIGS. 4 and 5, the length of the treatment path for the strip of non-woven 1 depends upon the required duration of heating or cooling of the non-woven 1 in order to bring about the desired compacting, or elimination of the same, and depends upon the speed with which the strip of non-woven 1 is to be conducted through the devices, as well as upon the nature and temperature of the treatment media. The minimum detention time of the fiber non-woven 1 in the mentioned treatment zones required to achieve the desired compacting, or its reversal, can be determined with adequate accuracy by means of samples of the strip of non-woven to be treated, e.g., by making use of a customary ironing press. The same applies to the other process parameters, such as treatment temperatures, pressure per unit of area, etc. In the case of such preliminary experiments as well, it is necessary to make sure that the non-woven samples will be adequately cooled off immediately after warm pressing, i.e., in the still compressed state, and that the non-woven samples will not find an opportunity to relax after warm pressing and before cooling, not even briefly, because, as a result, most of the compacting would be lost again.

EXAMPLE 1

Example 1 consists of experiments with a filler non-woven customarily used for the quilting of garments of delustered, crimped polyester fibers as customarily used for the purpose, with the following characteristics:

Individual fiber denier: 6.7 dtex

Fiber length (staple length): 60 mm

Both sides (top and bottom) reinforced by spraying on about 8 g/m$^3$ per side of a binding agent on an acrylic resin base.

Initial height (thickness): 12 mm

Weight per unit area: about 80 g/m$^2$

Dimensions of the non-woven: 200 mm×300 mm

On a customary steam ironing press, the non-woven was alternately 25 times compressed and steam-treated, whereby the height (thickness) of the non-woven was measured after every compression and steam treatment step. During compacting, the non-woven was compressed at a pressure of 300 cN/cm$^2$ and in the compressed state, treated for 5 sec. with steam of about 110° C., then, in the unchanged, compressed state, dried for 5 sec. at about 100° C., and immediately cooled off. Reversal steam-treatment was carried out with the ironing press open, during which operation the previously compressed non-woven was each time treated for 10 sec. with steam of about 100° C. and was able to expand freely. Table 1 lists the height (thickness) of the non-woven after every treatment step.

TABLE 1

| Number of Cycles | Height (thickness) of Non-Woven, mm | |
|---|---|---|
| | Compressed | Steam-Reversed |
| 1-2 | 1 | 11 |
| 3-6 | 1 | 10 |
| 7-16 | 1 | 9 |
| 17-25 | 1 | 8 |

As is shown by Table 1, even after 25 treatment cycles, i.e., after 25 times compressing to a thickness of 1 mm, under the conditions listed above, each time followed by steam reversal, the used polyester fiber non-woven of an original thickness of 12 mm, still attains a thickness of 8 mm during reversal steaming, which corresponds to about 67% of the original thickness and, compared to the thickness in the compressed state, to an 8-fold increase. Obviously, after the 17th cycle, a stable state has been reached in the non-woven, which returned after every reversal steaming.

EXAMPLE 2

Example 2 consists of experiments with a filler non-woven as customarily used for quilts, sleeping bags, etc.

Initial height (thickness): 30 mm

Weight per unit area: about 200 g/m$^2$

The other characteristics were as in the first experiment and the same applies to the processing conditions and the progress of the process. The results are compiled in Table 2.

TABLE 1

| Number of Cycles | Height (thickness) of Non-Woven, mm | |
|---|---|---|
| | Compressed | Steam-Reversed |
| 1 | 3 | 26 |
| 2 | 3 | 24 |
| 3 | 3 | 22 |
| 4, 5 | 3 | 21 |
| 6, 7 | 2 | 19 |
| 8-17 | 2 | 18 |
| 18-23 | 2 | 16 |
| 24, 25 | 2 | 15 |

Here, the non-woven of an original thickness of 30 mm still reached a thickness of 15 mm after the 25th treatment cycle. That corresponds to 50% of the original thickness and to 7.5 times the thickness obtained by the 25th compression step.

Normally, however, such non-wovens will have to be compacted only once and will have their bulk restored only after all other processing steps (finish steaming). As is shown by experiments 1 and 2, even after such an unusually high compression as was carried out for the sake of an example and which amounted to 1/12 or 1/10, steam reversal will still result in a thickness of the non-woven amounting to about 91.7% or about 86.7% if compacting is applied only once. Frequently, however, even less extensive compacting will be adequate for the desired purpose, so that one will encounter a correspondingly lower loss in thickness, if any at all.

EXAMPLE 3

Under the same conditions as in experiments 1 and 2, non-wovens of the same quality were compressed only once, but less strongly, by setting the pressure of the steam ironing press to a lower value. As is known, the closing pressure of customary steam ironing presses can usually be continuously adjusted from "low" to "very high", but it cannot be measured exactly. This experiment is only intended to show that a lower pressure per unit area during compressing will lead to less compacting of fiber non-wovens. The following was found:

A thickness of 2 mm for the non-woven of 12 mm thickness;

A thickness of 8 mm for the non-woven of 30 mm thickness.

After reversal steaming, both non-wovens had returned to their original thickness of 12 or 30 mm.

The same result can be obtained by reducing the time during which the steam or dry heat is applied, whereby the length of the selected treatment times may also vary.

EXAMPLE 4

Non-wovens as already used in experiments 1 and 2 were also subjected to experiments on a customary fixing press, i.e., with dry heat, at temperatures varying in a range from 100 to 180° C. The pressure per unit area used during compressing was always 400 cN/cm$^2$. Warm pressing lasted for 10 sec. The results are listed in Table 3.

TABLE 3

| Temperature °C. | Height (thickness) of non-woven, mm | | | |
|---|---|---|---|---|
| | Non-woven 1 = 12 mm | | non-woven 2 = 30 mm | |
| | Compressed | Reversed | Compressed | Reversed |
| 100 | 9 | 12 | 28 | 30 |
| 110 | 8 | 12 | 27 | 30 |
| 120 | 8 | 12 | 26 | 30 |
| 130 | 8 | 12 | 26 | 30 |
| 140 | 8 | 12 | 26 | 29 |
| 150 | 8 | 10 | 26 | 27 |
| 160 | 8 | 10 | 22 | 24 |
| 170 | 7 | 9 | 19 | 22 |
| 180 | 6 | 8 | 19 | 21 |

These experiments show the following: The increased pressure per unit area of 400 cN/cm$^2$ notwithstanding, even elevated temperatures resulted only in a substantially lower compacting than in compacting of the non-wovens with steam, as in experiments 1 to 3. In spite of the single compacting, a greater irreversible compacting occurred at the higher temperatures than before. Thus, the non-woven 1, compressed only once to 6 mm at 180° C., reached only 8 mm during reversal as had earlier, during compacting with steam, been obtained with the same non-woven only after the 17th compacting and 17th reversal, although there the non-woven had each time been compacted again to a thickness of 1 mm. In the case of non-woven 2, compacting at 180° C. resulted in the same thickness during reversal steaming, as previously only after the 4th cycle (see Table 2).

That a higher total compacting was obtained at higher temperatures than at lower temperatures was expected Depending upon what it is intended to accomplish with compacting pursuant to the invention, suitable processing conditions can thus be determined by means of a few experiment series. This also applies to non-wovens consisting wholly, or in part, of wool, cotton viscose rayon, or other synthetic fibers than those mentioned above.

It may frequently be advantageous to cover the non-wovens, at least on one side, with paper during compressing.

The data given in the examples for the height (thickness) of the non-wovens are average values for several measurements on each non-woven, which in addition have been rounded off, up or down.

Depending upon the kind of fibers, the manufacture, or the preliminary treatment of a non-woven, it may occur that the latter will have a greater volume, i.e., a greater thickness (height) than before compressing.

The suitability of the process pursuant to the invention for batting consisting of cotton and of viscose fibers has also been shown.

What is claimed is:

1. A temporarily and reversibly, under steaming conditions, compacted nonwoven matting of up to within one fifth its original thickness, said matting having been heated while in a compacted state to a temperature below that to change the state of aggregation of the fibers and cooled while compacted to retain said compaction until released.

2. The reversibly compacted matting of claim 1 manufactured from natural fibers or synthetic fibers.

3. The reversibly compacted matting of claim 2, wherein the natural fibers are selected from the group of wool, cotton and blends thereof.

4. The reversibly compacted matting of claim 1, wherein the synthetic fibers are selected from the group of polyester, cellulose, polyamide, polyacrylonitrile, polypropylene and blends thereof.

5. The temporarily and reversibly compacted matting of claim 1, further comprising slits, cuts or punched holes in said matting to reduce the stiffness thereof for rolling or bundling.

6. The temporarily and reversibly compacted matting of claim 1, including a superficial binding agent applied to at least one side thereof.

* * * * *